US005930899A

United States Patent [19]

Hartman et al.

[11] Patent Number: 5,930,899

[45] Date of Patent: Aug. 3, 1999

[54] MOLDING AND EMBLEM REMOVAL TOOL

[75] Inventors: Robert L. Hartman, Milwaukee; Roger A. Koessl, Kenosha, both of Wis.

[73] Assignee: Snap-on Tools Company, Kenosha, Wis.

[21] Appl. No.: 08/884,899

[22] Filed: Jun. 30, 1997

[51] Int. Cl.[6] ..... B25D 17/00

[52] U.S. Cl. ..... 30/168; 30/167; 173/206

[58] Field of Search ..... 30/168, 169, 277.4, 30/329, 337; 29/275; 81/463; 173/133, 132, 206, 210, 134

[56] References Cited

U.S. PATENT DOCUMENTS

| | | | |
|---|---|---|---|
| Re. 34,301 | 7/1993 | Brooks . | |
| 342,586 | 5/1886 | Deissler . | |
| 626,762 | 6/1899 | Leyner | 30/168 |
| 710,240 | 9/1902 | Belfield et al. . | |
| 712,843 | 11/1902 | Paul | 173/206 |
| 1,166,379 | 12/1915 | Ludlam . | |
| 1,334,686 | 3/1920 | Whyte | 30/167 |
| 1,436,407 | 11/1922 | Schurmann . | |
| 1,451,102 | 4/1923 | Neale | 30/167 |
| 1,613,399 | 1/1927 | Levedahl | 30/168 |
| 1,651,417 | 12/1927 | Stevens | 30/168 |
| 1,706,460 | 3/1929 | Norling | 30/168 |
| 1,782,463 | 11/1930 | Colantuono et al. . | |
| 1,787,229 | 12/1930 | Zimmermann | 30/168 |
| 1,817,591 | 8/1931 | Slatcher | 30/168 |
| 1,969,798 | 8/1934 | Hultquist | 30/168 |
| 2,444,040 | 6/1948 | Gower . | |
| 2,705,428 | 4/1955 | McCullough . | |
| 2,706,413 | 4/1955 | Mendenhall . | |
| 2,822,559 | 2/1958 | Manville . | |
| 3,008,361 | 11/1961 | Henning | 173/210 |
| 3,427,552 | 2/1969 | Sauer et al. . | |
| 3,530,577 | 9/1970 | Franklin et al. . | |
| 3,577,638 | 5/1971 | Chandler | 30/168 |
| 4,231,155 | 11/1980 | Johne . | |
| 4,381,604 | 5/1983 | Horst . | |
| 4,413,412 | 11/1983 | Wetzel . | |
| 4,416,338 | 11/1983 | Nelson et al. | 173/134 |
| 4,458,416 | 7/1984 | Hansson et al. . | |
| 4,466,167 | 8/1984 | Hoffman . | |
| 4,466,851 | 8/1984 | Hoffman . | |
| 4,732,221 | 3/1988 | Dudek . | |
| 4,832,524 | 5/1989 | Olgren . | |
| 4,885,978 | 12/1989 | Caenazzo et al. . | |
| 4,893,978 | 1/1990 | Frano . | |
| 4,993,501 | 2/1991 | Zannini . | |
| 5,009,131 | 4/1991 | Alto et al. . | |
| 5,027,022 | 6/1991 | Tanaka et al. . | |
| 5,058,273 | 10/1991 | Streger . | |
| 5,140,752 | 8/1992 | Kasprzak . | |
| 5,170,532 | 12/1992 | Holmin et al. . | |
| 5,219,378 | 6/1993 | Arnold . | |
| 5,287,582 | 2/1994 | Kawai et al. . | |
| 5,365,637 | 11/1994 | Bodell et al. . | |
| 5,469,623 | 11/1995 | Roeker et al. . | |
| 5,491,896 | 2/1996 | Stolzer et al. . | |

*Primary Examiner*—Hwei-Siu Payer
*Attorney, Agent, or Firm*—Emrich & Dithmar

[57] ABSTRACT

A pneumatic scraping tool includes a pneumatic hammer assembly including a cylinder in which a piston reciprocates for repeated impact against an anvil or blade holder which is rotatably received within an end of the cylinder and carries a scraping blade. The anvil has an annular flange which stops its insertion in the cylinder, and is retained in place by a nut threadedly engaged with the cylinder and having an end wall spaced from the cylinder end a distance slightly greater than the flange thickness to permit reciprocation of the anvil. Exhaust air passes along a groove in the outer surface of the cylinder to an annular chamber in the nut and thence through four exhaust ports exiting at the end wall of the nut. A plug portion of the anvil projects through a central opening in the nut end wall and is received into a socket in a blade housing. Blade fingers project laterally into the socket. Alternating side grooves and flats on the plug portion allow the blade assembly to be rotated roughly one-quarter turn between a latched condition and a release condition in which the plug portion can be inserted into and removed from the socket. A spring-biased detent ball in the cylinder engages a square inner end of the anvil to form a ratchet, accommodating rotation of the anvil in only one direction.

20 Claims, 2 Drawing Sheets

MOLDING AND EMBLEM REMOVAL TOOL

BACKGROUND OF THE INVENTION

1. Field of the Invention

This invention relates to a power tool and, more particularly, to a pneumatically-operated tool, such as a scraping tool for removing moldings, emblems and the like.

2. Description of the Prior Art

The present invention is an improvement of the scraping tool disclosed in U.S. Pat. No. 4,416,338. That patent discloses a pneumatically operated hammer assembly of the reciprocating piston type. The tool has a cylindrical housing which receives in the forward or working end thereof one end of an anvil or blade holder, which is fixed to the cylindrical housing, as by roll pins. The outer end of the blade holder is, in turn, fixed to a scraping blade. A pneumatic control assembly is coupled to the rear end of the cylindrical housing and a piston slidably reciprocates inside the housing between this control assembly and the anvil or blade holder. The control assembly includes a ball valve which responds to pressure differences to automatically alternate between positions respectively admitting pressurized air ahead of or behind the piston to control its reciprocation. Each time the piston moves forwardly it impacts the anvil to impart a vibrational force to the scraping blade.

This prior scraping tool is designed for removing stuck gasket material from automotive engine parts. While the tool performs adequately for that purpose, it has relatively low output and is unable to cut through molding adhesive. Because the blade holder is pinned to the housing, the blade simply vibrates and does no work.

In the prior scraping tool, the blade is affixed to the blade holder by means of a set screw which extends through an opening in the blade. The blade can be damaged in use and/or may need sharpening. Also, it is desirable to offer blades in different sizes, all of which will require removal of the blade from the holder. This is somewhat cumbersome and time consuming in the prior art device, requiring the use of a screwdriver or similar tool. In the prior scraping tool, since the anvil or blade holder is pinned to the housing, is cannot be removed.

SUMMARY OF THE INVENTION

It is a general object of the invention to provide an improved power tool, which avoids the disadvantages of prior tools while affording additional structural and operating advantages.

An important feature of the invention is the provision of a tool of the type set forth, which includes a blade which is reciprocated against the associated work.

In connection with the foregoing feature, another feature of the invention is the provision of a tool of the type set forth, wherein a blade holder is impacted by a reciprocating piston member.

Still another feature of the invention is the provision of a tool of the type set forth, wherein the blade can be easily removed and replaced.

In connection with the foregoing feature, another feature of the invention is the provision of a tool of the type set forth, which provides a simple unidirectionally rotatable lock mechanism for retaining the blade on the blade holder.

In connection with the foregoing features, another feature of the invention is the provision of a tool of the type set forth which prevents damage to the blade by improper rotation.

Yet another feature of the invention is the provision of a tool of the type set forth, which is of relatively simple and economical construction.

Certain ones of these features of the invention are attained by providing, in a pneumatic scraping tool including a cylinder having a longitudinal axis, an anvil disposed at an end of the cylinder, a work-engaging blade carried by the anvil, a piston disposed in the cylinder and adapted to be reciprocated by pressurized air into repetitive engagement with the anvil, and control mechanism coupled to the cylinder for controlling the flow of air therethrough, the improvement comprising: a retaining nut threadedly engaged with the end of the cylinder for cooperation therewith to retain the anvil in place, the nut having an end wall spaced a predetermined distance axially from the cylinder end, the anvil having a flange disposed between the cylinder end and the end wall of the nut and having a thickness slightly less than the predetermined distance for providing a clearance space to accommodate reciprocating movement of the anvil in response to engagement thereof by the piston.

Other features of the invention are attained by providing, in a power tool including a blade holder, a blade carried by the blade holder, and a drive assembly coupled to the blade holder for applying operating forces thereto, the improvement comprising: a blade housing integral with the blade and defining a socket, the blade having a finger extending laterally into the socket, the blade holder having a plug portion receivable in the socket and having an axial groove along a side thereof to accommodate said finger to permit free insertion and removal of said plug portion into and from said socket in a first rotational position, said finger being deflectable to accommodate rotation of said plug portion within said socket from said first rotational position, said plug portion having a detent portion engageable with said finger in a second rotational position to prevent withdrawal of said plug portion from said socket.

Still other features of the invention are attained by providing, in a power tool including a cylindrical housing having an axial bore formed therein, a blade holder rotatably received coaxially in an end of the bore, and a drive assembly coupled to the blade holder for applying operating forces thereto, the improvement comprising: a stop surface on the housing intersecting the bore, a detent member carried by the housing and movable between a first condition engaging the stop surface and projecting into the bore and a second condition withdrawn from the bore, a bias member resiliently urging the detent member to the first condition, and a detent surface on the blade holder providing clearance for the detent member in its first condition when the blade holder is disposed in a first rotational position, the detent member being movable to its second condition against the urging of the bias member to accommodate rotation of the blade holder from its first position in a first rotational direction, the detent member engaging the stop surface to prevent rotation of the blade holder from its first position in a second rotational direction.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
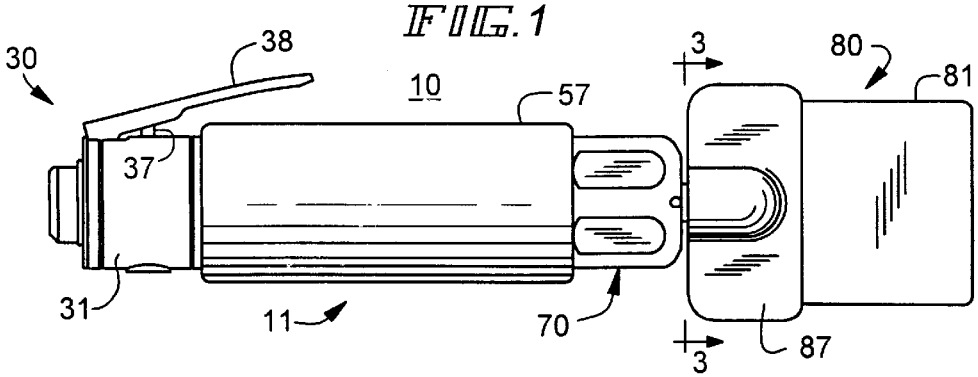
FIG. 1 is a side elevational view of a pneumatic scraping tool constructed in accordance with and embodying the features of the present invention.
Figure 2:
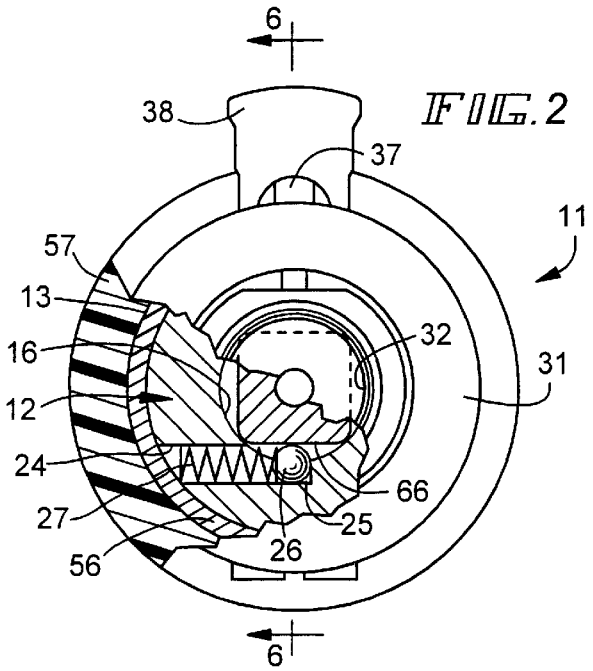
FIG. 2 is an enlarged end elevational view of the left-hand end of the tool of FIG. 1, with portions broken away and illustrated in section more clearly to show the internal construction.
Figure 6:
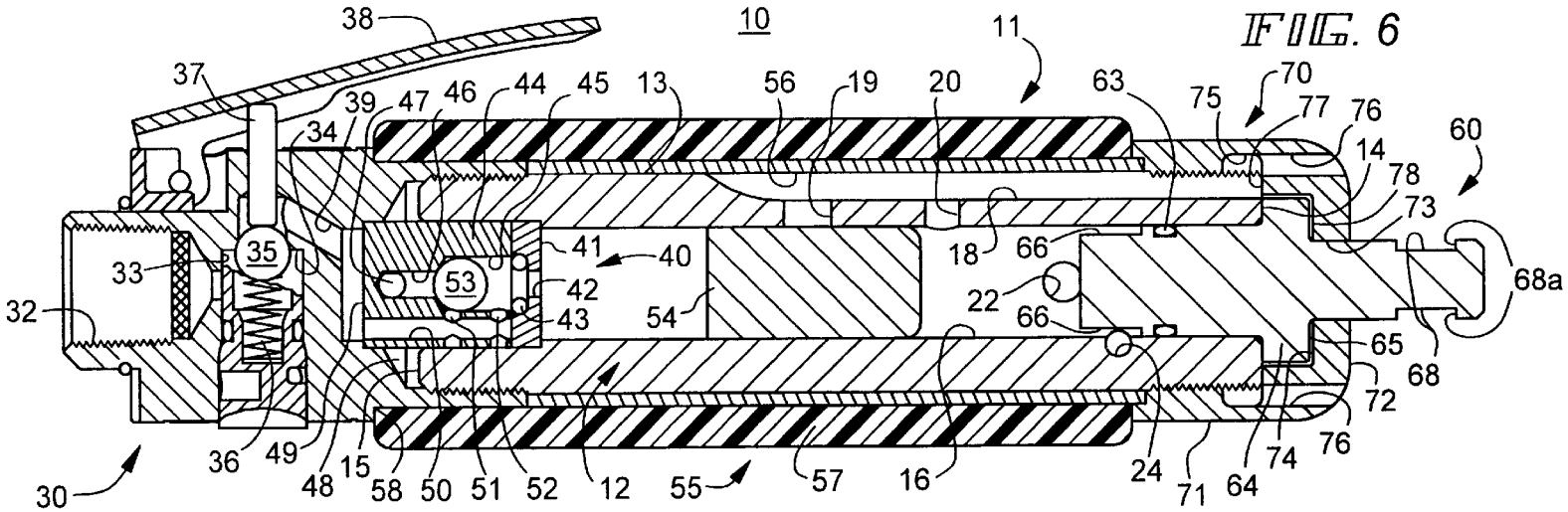
FIG. 6 is a reduced view in vertical section taken along the line 6—6 in FIG. 2.
Figure 7:
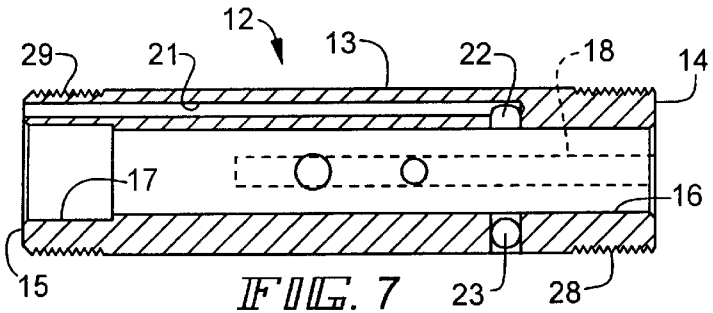
FIG. 7 is a further reduced sectional view of the housing of the tool of FIG. 6, taken along a section line rotated 90° from that of FIG. 6.

Referring now to FIGS. 1, 2 and 6, there is illustrated a power tool in the form of a pneumatic scraping tool, generally designated by the numeral 10, constructed in accordance with and embodying the features of the present invention. The scraping tool 10 includes a pneumatic hammer assembly 11 having a central tubular housing 12. Referring also to FIG. 7, the housing 12 has a cylindrical outer surface 13 terminating at a circular front end surface 14 and a rear end surface 15. The housing 12 has an axial bore 16 extending longitudinally therethrough and provided with a counterbore 17 adjacent to the rear end surface 15. Formed in the outer surface 13 of the housing 12 is an elongated exhaust groove or passage 18 which extends from the front end surface 14 rearwardly approximately two-thirds of the length of the housing 12 (see FIG. 6). The exhaust groove 18 communicates with the axial bore 16 through two longitudinally spaced-apart radial ports 19 and 20. A small, circularly cylindrical passage 21 extends parallel to the axial bore 16 from the rear end surface 15 approximately three-quarters of the length of the housing 12, and communicates at its forward end with a radial port 22 which intersects the axial bore 16, and may be closed on the opposite side of the axial bore 16, as by a stop ball 23.

Referring in particular to FIGS. 2 and 6, a bore 24 is formed in the housing 12 just forwardly of the port 22 along a chord of the housing 12, intersecting the axial bore 16 and terminating at an end or stop surface 25. A detent ball 26 is disposed in the bore 24, and is resiliently urged against the stop surface 25 by a helical compression spring 27. The outer surface 13 of the housing 12 is externally threaded, as at 28 and 29, respectively adjacent to the front and rear ends of the housing 12.

The hammer assembly 11 also includes a control assembly, generally designated by the numeral 30, which includes a control body 31 having an internally threaded air inlet 32 adapted to be coupled to a suitable fitting (not shown) of an associated inlet conduit for compressed air, all in a known manner. The forward end of the control body 31 is threadedly engaged with the threaded portion at 29 on the rear end of the housing 12. The inlet 32 communicates with a valve chamber 33, which defines a valve seat 34 against which a valve ball 35 is urged by a helical compression spring 36. A plunger 37 is slidably disposed in a passage in the control body 31 for engagement with the valve ball 35 and is operable by a pivoting handle 38 to depress the valve ball 35 against the urging of the spring 36 to open the valve and allow compressed air to pass therethrough into a passage 39.

The control assembly 30 also includes a ball valve assembly 40, which is disposed in the counterbore 17 of the housing 12 and is retained in place by the control body 31. More particularly, referring to FIG. 6, the ball valve assembly 40 includes a circular end plate 41 seated at the forward end of the counterbore 17 and having an axial opening 42 formed centrally therethrough. The rearward end of the opening 42 is surrounded by an O-ring 43. Disposed against the rear surface of the end plate 41 is a valve body 44, the rear end of which projects rearwardly beyond the rear end surface 15 of the housing 12 and is seated against a shoulder of the control body 31. Formed axially in the forward end of the body 44 is a cylindrical chamber 45, the rear end of which communicates with an axially extending reduced-diameter passage 46, which in turn communicates at its rearward end with a radially extending passage 47, which exits the body 44 and communicates with an annular passage 48 surrounding the body 44 and defined between the control body 31 and the rear end surface 15 of the housing 12. The body 44 has a rear end face 49 which bounds the passage 39. An inlet passage 50 extends into the valve body 44 from the rear end thereof and communicates with the chamber 45 through radial ports 51 and 52. A valve ball 53 is disposed in the chamber 45, and is movable therein between a rearward position, illustrated in FIG. 6, closing the passage 46 and the port 51, and a forward position (not shown) against the O-ring 43 for closing the axial opening 42 and the port 52. A cylindrical piston 54 is slidably disposed in the axial bore 16 of the housing 12 forwardly of the ball valve assembly 40.

The pneumatic hammer assembly 11 is surrounded by a grip assembly 55, which is of two-part construction, including a cylindrical inner sleeve 56 formed of a rigid, gas-impermeable material, and an outer sleeve 57 formed of a suitable elastomeric material and having a sufficient thickness to afford a comfortable cushioning and frictional grip for a user's hand. Preferably, the inner sleeve 56 engages the outer surface 13 of the housing 12 between the threaded portions 28 and 29 and serves to close the underlying portion of the exhaust groove 18, and to retain the spring 27 in the bore 24 of the housing 12 (see FIG. 2). The outer sleeve 57 surrounds the inner sleeve 56 along substantially its entire length and extends rearwardly therefrom in overlapping relationship with the forward end of the control body 31, preferably being seated against an annular shoulder 58 thereof. The sleeves 56 and 57 may be fixedly secured together, as by a suitable adhesive.

Figure 3:
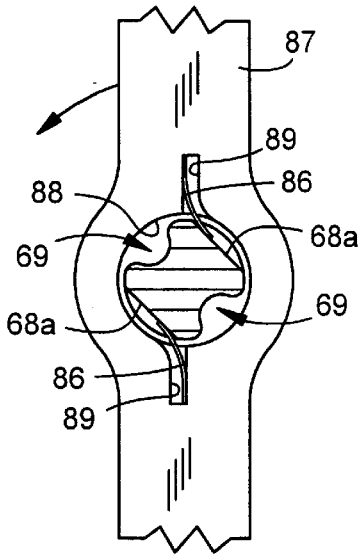
FIG. 3 is an enlarged, fragmentary view in vertical section taken along the line 3—3 in FIG. 1.
Figure 5:
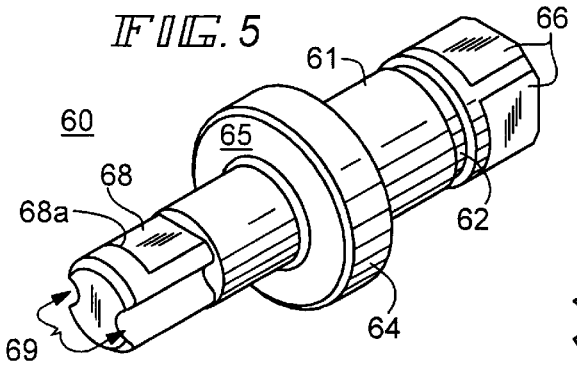
FIG. 5 is an enlarged, perspective view of the blade holder of the tool of FIG. 1.
Figure 4:
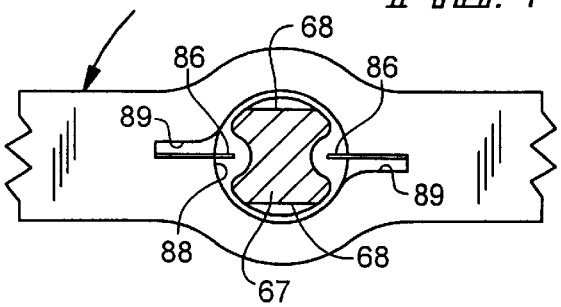
FIG. 4 is a view similar to FIG. 3, with the blade rotated to a position for removal.

Referring also to FIG. 5, the scraping tool 10 further includes a blade holder 60 having an elongated cylindrical body 61 provided with a circumferential groove 62 in which an O-ring 63 is seated. The body 61 is dimensioned to be coaxially received in the forward end of the axial bore 16 of the housing 12, the O-ring 63 providing an air-tight seal therebetween. The body 61 is provided with a radially outwardly extending annular flange 64 which engages the front end surface 14 of the housing 12 to limit the depth of insertion of the blade holder 60 therein, the flange 64 having an annular outer front surface 65. When the cylindrical body 61 is fully inserted in the housing 12 its rear end extends to the port 22, but does not substantially obstruct it. Preferably, the rear end of the cylindrical body 61 is substantially square in transverse cross section, defining four flat, planar detent surfaces 66 disposed for engagement with the detent ball 26, as can best be seen in FIGS. 2 and 6. Referring also to FIGS. 3 and 4, the blade holder 60 has a reduced-diameter neck 67, which projects forwardly from the flange 64 and is provided adjacent to its distal end with two diametrically opposed flats 68, which define stop shoulders 68*a*. Also formed in the outer surface of the neck 67 at diametrically opposed locations, spaced respectively 90° from the flats 68, are two longitudinal grooves 69, which extend rearwardly from the front end of the neck 67.

Figure 8:
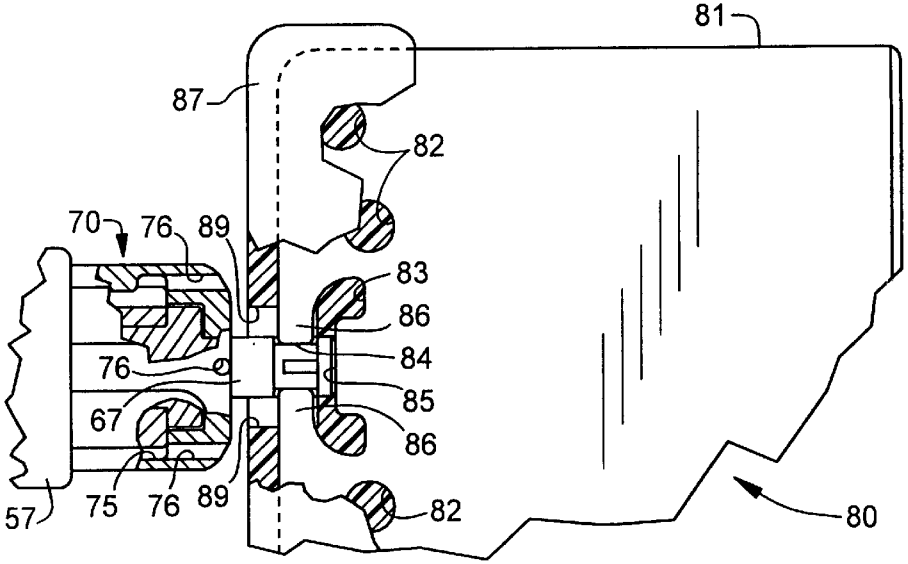
FIG. 8 is an enlarged, fragmentary view of the right-hand end of the tool of FIG. 1, with portions broken away more clearly to illustrate the internal construction.

Referring now in particular to FIGS. 6 and 8, the scraping tool 10 also includes a retaining nut 70 having a cylindrical side wall 71 closed at the forward end thereof by a circular end wall 72 with a central axial opening 73 formed therethrough and having a circular inner surface 74. The side wall 71 is threadedly engaged with the forward end of the housing 12 at 28 until an annular inner shoulder 77 in the nut 70 stops against the front end surface 14 of the housing 12. Formed in the inner surface of the side wall 71 just rearwardly of the shoulder 77 is an annular groove 75 which defines an annular chamber surrounding the forward end of the housing 12 and communicating with the exhaust groove 18. Extending longitudinally into the side wall 71 from the end wall 72 are four equiangularly spaced-apart passages 76 which communicate with the annular chamber 75 and form exhaust ports for the pneumatic hammer assembly at the front end of the tool 10, as will be explained in greater detail below.

It is a significant aspect of the invention that, when the retaining nut 70 is fully threaded onto the housing 12 with its shoulder 77 stopped against the front end surface 14, the inner surface 74 of the end wall 72 is spaced from the front end surface 14 by an axial distance slightly greater than the thickness of the flange 64 of the blade holder 60. Thus, there is formed a clearance space 78 between the flange 64 on the one hand and the nut end wall 72 or the housing front end wall 14 on the other hand to permit a slight axial reciprocating movement of the blade holder 60, as will be explained more fully below.

Referring now to FIGS. 1, 3–6 and 8, the scraping tool 10 is also provided with a blade assembly 80, which includes a thin, flat, metal blade 81 substantially rectangular in shape, and which may be beveled at its front or working end, in a known manner. A plurality of holes 82 are formed through the blade 81 adjacent to its rearward end. Also formed through the blade 81 centrally of its rearward end is a generally C-shaped opening 83 communicating via a short neck opening 84 with the rear end of the blade 81. The C-shaped opening 83 defines a stop surface 85 centrally thereof, and cooperates with the neck opening 84 to define two fingers 86 which terminate at opposite sides of the neck opening 84. The rear end of the blade 81 is embedded in a housing 87, which is preferably formed of a suitable plastic material and may be fabricated by insert molding. During the molding operation, the plastic material flows through the holes 82 and the distal ends of the C-shaped opening 83 to securely anchor the blade 81 in the housing 87. Formed in the housing 87 is a cylindrical inlet opening 88 which is coaxial with the neck opening 84 between the fingers 86. Side recesses 89 are formed in the housing 87 and communicate with the inlet opening 88 at approximately diametrically opposed locations aligned with the fingers 86. Preferably, the inlet opening 88 has a diameter slightly greater than the width of the neck opening 84 in the blade 81, so that the distal ends of the fingers 86 respectively project a slight distance into the inlet opening 88, as can best be seen in FIGS. 3 and 4. Also, the side recesses 89 are parallel to but disposed respectively on opposite sides of a common diametral plane. The fingers 86 are preferably thinner than the widths of the side recesses 89 and each finger is disposed along the side of the corresponding recess 89 closest to the common diametral plane, with the tip portion of the finger 86 projecting into the inlet opening 88, so as to facilitate deflection of the fingers 86 in only one direction, as will be explained more fully below.

The hammer assembly 11 operates in essentially the same manner as that described in the aforementioned U.S. Pat. No. 4,416,338. Thus, when the handle 38 is depressed, compressed air is admitted through the control valve into the passage 39, and thence through the inlet passage 50 of the ball valve assembly 40. When the ball 53 is in its left-hand position, illustrated in FIG. 6, the air enters the chamber 45 ahead of the ball 53 through the port 52 and then flows through the opening 42 into the axial bore 16 of the housing 12 behind the piston 54, for urging the piston 54 forwardly to impact against the rear end of the blade holder 60. Air in the axial bore 16 ahead of the piston 54 is initially exhausted through the port 20, exhaust passage 18 and exhaust passages 76. As the piston 54 passes and closes the exhaust port 20, its continued forward movement serves to increase the pressure against the rear of the valve ball 53 via port 22, and passages 21, 48, 47 and 46. When the piston 54 passes and opens port 19, the flow of air therethrough reduces the pressure ahead of the valve ball 53 until it is less than that behind the valve ball 53, thereby serving to drive the ball 53 forwardly against the O-ring 43, closing the opening 42 and the port 52.

When the ball 53 is in this forward position, compressed air must enter the chamber 45 through the port 51 rearwardly of the ball 53. This will serve to hold the ball 53 forwardly and also allows the compressed inlet air to flow through the passages 46, 47, 48 and 21 into the axial bore 16 of the housing 12 ahead of the piston 54 through the port 22, the piston 54 having rebounded from impact with the blade holder 60 sufficiently to expose the port 22. Thus, the compressed air now drives the piston 54 rearwardly. Air behind it is initially exhausted through the port 19 and then through the exhaust passages 18 and 76. After the piston 54 covers the port 19, the remaining air behind the piston 54 is compressed enough to drive the ball 53 rearwardly, reopening the port 52 and restarting the cycle.

Thus, the piston 54 is automatically reciprocated back and forth against the rear end of the blade holder 60. Normally, the force of the user urging the blade 81 against the work holds the flange 64 of the blade holder 60 rearwardly against the front end surface 14 of the housing 12. Each time the blade holder 60 is impacted by the piston 54, it is reciprocated forwardly through the clearance space 78 against the end wall 72 of the retaining nut 70. This reciprocating movement of the blade holder 60 and the blade 81 carried thereby permits the blade 81 to do considerable work and greatly increases the efficiency of operation of the scraping tool 10. Air exhausting from the front of the tool 10 serves to blow away debris created by the scraping process.

It is a significant aspect of the invention that the blade assembly 80 is easily removable from the blade holder 60 for purposes of repair, replacement and the like. In this regard, a number of different sizes of blade assemblies may be provided for interchangeable use on the scraping tool 10. When it is desired to mount the blade assembly 80 on the blade holder 60, the blade assembly 80 is positioned so that the fingers 86 respectively align with the grooves 69 on the blade holder 60, as illustrated in FIG. 4. This permits the projecting neck 67 of the blade holder 60 to be inserted into the socket defined by the inlet opening 88 and the neck opening 84 of the blade assembly 80. As shown in FIG. 8, the neck 67 is inserted until it stops against the stop surface 85 of the blade 81. Then the blade assembly 80 is rotated in the direction of the arrow in FIG. 4, the distal ends of the fingers 86 being deflectable toward the opposite sides of the side recesses 89 by engagement with the blade holder neck 67 to accommodate this rotation. After the blade assembly 80 has been rotated through somewhat more than 90° from the position of FIG. 4, the distal ends of the fingers 86, respectively, are disposed against the flats 68 of the blade holder neck 67, as illustrated in FIG. 3, wherein the stop shoulders 68*a* prevent removal of the blade assembly 80. If, and when, it is desired to remove the blade assembly 80, it is again rotated through somewhat less than 90° from the position of FIG. 3 in the direction of the arrow, back to a position 180° from the FIG. 4 position.

It is significant that the location and orientation of the fingers 86 relative to the side recesses 89 of the blade housing 87 effectively facilitate rotation of the blade assembly 80 in the direction of the arrows in FIGS. 3 and 4 and inhibit rotation in the opposite direction, once the blade holder neck 67 is inserted in the socket of the blade assembly 80. In order to prevent a user from forcing the blade assembly 80 in this opposite direction, thereby damaging the fingers 86, it is another significant aspect of the invention that the detent ball 26 cooperates with the blade holder 60 to provide a ratcheting operation. Referring in particular to FIGS. 2 and 6, when the blade assembly 80 is rotated on the blade holder 60 in the direction of the arrows of FIGS. 3 and 4, this will initially tend to rotate the blade holder 60 in a counterclockwise direction, as viewed in FIG. 2. But this movement will tend to wedge the detent ball 26 more firmly against the stop surface 25 and effectively prevent rotation of the blade holder 60 in that direction. Thus, the blade assembly is forced to rotate relative to the blade holder 60. If the user attempts to rotate the blade assembly 80 backwards from the direction of the arrows shown in FIGS. 3 and 4, it will again tend to rotate the blade holder 60, this time in a clockwise direction, as viewed in FIG. 2. As the blade holder 60 starts to rotate, the detent ball 26 is moved to the left into the bore 24 against the urging of the spring 27, allowing the corners of the square end of the blade holder 60 to move past the detent ball 26. As each corner passes the ball 26, the adjacent flats 68 on the blade holder 60 will allow the ball 26 to return against the stop surface 25 in a ratcheting-type of motion which the user will be able to feel. This, and the fact that the blade assembly 80 fails to engage on the blade holder 60, will indicate to the user that he is turning the blade assembly 80 in the wrong direction.

The above-described one-way ratcheting operation of the blade holder 60 also affords an important advantage in that it permits the operator to orient the blade 81 in any desired orientation relative to the control assembly handle 38 for maximum user comfort. Thus, absent the ratchet mechanism of this invention, the blade holder 60 would have to non-rotatably mounted to ensure that the blade assembly 80 could rotate with respect to it. Thus, since the control assembly 30 is threadedly mounted at the rear of the tool and the retaining nut 70 is threadedly mounted at the front, the user would have no control over the final orientation of the blade. With the present invention, the user can ratchet the blade holder 60 to any desired orientation.

From the foregoing, it can be seen that there has been provided an improved pneumatic scraping tool of the reciprocating piston type, which affords a limited reciprocating movement of the scraping blade and also permits easy removable mounting of the blade assembly on the tool for interchangeability of blades, while affording simple quarter-turn locking of the blade assembly in place without damage to the blade assembly.

While a particular embodiment of the present invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. In a power tool including a cylindrical housing having an axial bore formed therein, a blade holder rotatably received coaxially in an end of the bore, and a drive assembly coupled to the blade holder for applying operating forces thereto, the improvement comprising:

a stop surface on the housing intersecting the bore, a detent member carried by the housing and movable between a first condition engaging said stop surface and projecting into the bore and a second condition withdrawn from the bore, a bias member resiliently urging said detent member to said first condition, and a detent surface on said blade holder providing clearance for said detent member in its first condition when said blade holder is disposed in a first rotational position, said detent member being movable to its second condition against the urging of said bias member to accommodate rotation of said blade holder from its first position in a first rotational direction, said detent member engaging said stop surface to prevent rotation of said blade holder from its first position in a second rotational direction.

2. The tool of claim 1, wherein said detent member is a ball, and said blade holder has an inner end substantially square in transverse cross section defining four detent surfaces.

3. In a power tool including a blade holder, a blade carried by the blade holder, and a drive assembly coupled to the blade holder for applying operating forces thereto, the improvement comprising:

a blade housing integral with the blade and defining a socket, the blade having a finger extending laterally into the socket, the blade holder having a plug portion receivable in the socket and having an axial groove along a side thereof to accommodate said finger to permit free insertion and removal of said plug portion into and from said socket in a first rotational position, said finger being def lectable to accommodate rotation of said plug portion within said socket from said first rotational position, said plug portion having a detent portion engageable with said finger in a second rotational position to prevent withdrawal of said plug portion from said socket.

4. The tool of claim 3, wherein said blade has two fingers extending laterally into the socket, said blade holder having two axial grooves along opposite sides thereof to respectively accommodate said fingers.

5. The tool of claim 3, wherein said finger is unitary with said blade.

6. The tool of claim 3, wherein said finger is disposed so as to facilitate deflection thereof in one direction while inhibiting deflection in an opposite direction so as to effectively limit said plug portion to rotation in a single direction.

7. The tool of claim 3, wherein said groove and said detent portion are so positioned on said plug portion that said first and second rotational positions are less than 180° apart.

8. The tool of claim 3, wherein the drive assembly is a pneumatic hammer assembly which includes a cylinder having an end, said blade holder being rotatably received in said cylinder at said end.

9. The tool of claim 8, and further comprising ratchet mechanism carried by said cylinder and cooperating with said blade holder for permitting rotation of said blade holder in only one direction.

10. The tool of claim 9, wherein said cylinder defines an axial bore receiving the blade holder, said ratchet mechanism including a stop surface on said cylinder intersecting said bore and a detent member carried by said cylinder and movable between a first condition engaging the stop surface and projecting into the bore and a second condition withdrawn from the bore, and bias means resiliently urging said detent member to said first condition, and a detent surface on said blade holder providing clearance for said detent member in its first condition when said blade holder is in a first rotational position, said detent member being movable to its second condition against the urging of said bias means to accommodate rotation of said blade holder from its first position in a first rotational direction, said detent member engaging said stop surface to prevent rotation of said blade holder from its first position in a second rotational direction.

11. The tool of claim 10, wherein said blade holder has an inner end substantially square in transverse cross section defining four detent surfaces.

12. In a pneumatic tool including a cylinder having a longitudinal axis, an anvil disposed at an end of the cylinder, a work-engaging blade carried by the anvil, a piston disposed in the cylinder and adapted to be reciprocated by pressurized air into repetitive engagement with the anvil, and control mechanism coupled to the cylinder for controlling the flow of air therethrough, the improvement comprising:

a retaining nut threadedly engaged with the end of the cylinder for cooperation therewith to retain the anvil in place, said nut having an end wall spaced a predetermined distance axially from the cylinder end, said anvil having a flange disposed between the cylinder end and said end wall of said nut and having an axial thickness slightly less than said predetermined distance for providing an axial clearance space substantially less than said thickness to accommodate reciprocating movement of the anvil in response to engagement thereof by the piston.

13. The tool of claim 12, wherein said end wall of said nut has a central opening therein, said anvil extending through said opening, said blade being connectable to said anvil externally of said retaining nut.

14. The tool of claim 12, wherein said anvil is received coaxially in the cylinder.

15. The tool of claim 14, and further comprising a pneumatic seal disposed between the anvil and the cylinder.

16. The tool of claim 15, wherein the cylinder has an exhaust passage formed therein and exiting adjacent to the end thereof, said retaining nut having an exhaust port formed therein communicating with the exhaust passage and exiting at said end wall of said nut.

17. The tool of claim 12, wherein said cylinder has an air exhaust passage formed therein and exiting adjacent to the end of said cylinder.

18. The tool of claim 17, and further comprising a grip assembly encircling said cylinder and including an inner rigid and air-impermeable portion covering said exhaust passage and an outer flexible and resilient cushioning portion.

19. The tool of claim 17, wherein said retaining nut has an annular chamber formed therein communicating with said exhaust passage, and an exhaust port formed in said retaining nut and communicating with said annular chamber and exiting at said end wall of said nut.

20. The tool of claim 19, wherein said nut has a plurality of exhaust ports therein communicating with said annular chamber and exiting at said end wall of said nut.

* * * * *

UNITED STATES PATENT AND TRADEMARK OFFICE

CERTIFICATE OF CORRECTION

PATENT NO. : 5,930,899

DATED : August 3, 1999

INVENTOR(S) : Robert L. Hartman and Roger A. Koessl

It is certified that error appears in the above-indentified patent and that said Letters Patent is hereby corrected as shown below:

Column 8, line 65, "def lectable" should be --deflectable--.

Signed and Sealed this

Eighteenth Day of April, 2000

*Attest:*

Q. TODD DICKINSON

*Attesting Officer*

*Director of Patents and Trademarks*